US008365325B2

(12) United States Patent
Schneider

(10) Patent No.: US 8,365,325 B2
(45) Date of Patent: Feb. 5, 2013

(54) INFANT BLANKET WRAP WITH BIFURCATED LEGS

(76) Inventor: Rhonda Schneider, Lewiston, ID (US)

( * ) Notice: Subject to any disclaimer, the term of this patent is extended or adjusted under 35 U.S.C. 154(b) by 0 days.

(21) Appl. No.: 13/249,002

(22) Filed: Sep. 29, 2011

(65) Prior Publication Data

US 2012/0102645 A1 May 3, 2012

Related U.S. Application Data

(60) Provisional application No. 61/409,161, filed on Nov. 2, 2010.

(51) Int. Cl.
*A47G 9/02* (2006.01)
*A41B 13/06* (2006.01)

(52) U.S. Cl. ..... 5/494; 5/413 R; 5/485; 2/69.5

(58) Field of Classification Search ..... 5/482, 485, 5/486, 494, 413 R, 416; 2/69.5, 71, 72, 75; 296/81, 82; D2/719
See application file for complete search history.

(56) References Cited

U.S. PATENT DOCUMENTS 1,584,853 A * 5/1926 Dern ..... 2/69
3,412,407 A * 11/1968 Key ..... 2/69.5
4,125,903 A * 11/1978 Farrell ..... 2/69.5
4,172,300 A * 10/1979 Miller ..... 5/424
4,611,353 A 9/1986 Als
5,046,204 A 9/1991 Mohler
5,058,226 A * 10/1991 Crosby ..... 5/494
5,722,094 A * 3/1998 Ruefer ..... 2/69.5
5,781,946 A 7/1998 McEntire
5,950,261 A 9/1999 Hay
D423,760 S * 5/2000 Sorenson ..... D2/719
6,145,932 A * 11/2000 Hamel-Nyhus et al. ..... 297/465
6,341,397 B1 * 1/2002 Kliegl et al. ..... 5/482
6,415,442 B1 7/2002 Smith
6,757,922 B2 7/2004 Chancey
6,948,200 B2 * 9/2005 Wyman ..... 5/494
7,647,658 B2 * 1/2010 Wilson ..... 5/482

* cited by examiner

*Primary Examiner* — Michael Trettel
(74) *Attorney, Agent, or Firm* — Daniel Boudwin; Christopher Feigenbutz

(57) ABSTRACT

Disclosed is an infant blanket wrap that is specially tailored for use in an infant carrier or car seat having a crotch strap. The present invention comprises an article of material with two flaps, a bifurcated leg portion that forms a pouch for each leg and a securing means for the upper terminal end of the leg portion. The bifurcated leg portion allows a parent to place a swaddled baby in an infant carrier without removing the blanket and disturbing the child. The device also includes a securing means for the bifurcated leg portion. This allows the leg portion to fold down for ease of entry into the blanket and creates an extended tube portion that covers the infant's torso, keeping the child completely covered.

6 Claims, 2 Drawing Sheets

INFANT BLANKET WRAP WITH BIFURCATED LEGS

CROSS REFERENCE TO RELATED APPLICATION

This application claims the benefit of U.S. Provisional Application No. 61/409,161 filed on Nov. 11, 2011, entitled "Infant Safety Strap Blanket."

BACKGROUND OF THE INVENTION

1. Field of the Invention

The present invention relates generally to the field of infant blankets. More specifically, the present invention pertains to an infant blanket wrap that is specially tailored for use in an infant car seat carrier and may further be utilized with any general type of infant seat that may or may not employ separated leg regions.

The practice of wrapping an infant in a blanket is known as swaddling, which is an age old tradition that provides benefits for both the child and the caretaker. Swaddled infants allow for improved transportation and carriage of the child, while the wrapping prevents movement of the infant's limbs and risk of injury.

Swaddling has become a popular practice for caretakers in recent years, thanks in part to recent studies suggesting that wrapping infants in blankets helps babies both to fall asleep, and remain asleep. In addition, some studies suggest that swaddling lowers the risk of Sudden Infant Death Syndrome (SIDS). The sudden increase in popularity has created a demand for and abundance of swaddling blankets in the marketplate. In the past, parents could use a standard square or diamond shaped blanket to swaddle their child. Today, parents are constantly traveling, requiring the use of an infant carrier seat to move their children. The modern infant carrier and car seat utilizes a five-point harness to secure a child, which places a securing strap between the legs of a child to prevent submarining during sudden movements or a automobile collision. This makes it impossible to use a standard blanket to wrap an infant in a carrier, since the crotch strap prevents an infant's legs from properly fitting inside the carrier.

Many swaddling blankets have been created for use with a five point harness, however their designs create additional problems. Several of these designs utilize a bifurcated or split leg portion that makes it difficult to insert an infant's legs properly into the blanket. Other designs attempt to work around this problem by making the bifurcated leg portion cover only the lower half of the infant's legs; however designs such as this do not completely cover the infant's torso.

The present invention improves upon infant blanket wraps with a bifurcated leg portion that are specially designed for use in an infant carrier. The device comprises an article of material with two flaps, a bifurcated leg portion that forms a pouch for each leg and a securing means for the upper terminal end of the leg portion. The bifurcated leg portion allows a parent to place a swaddled baby in an infant carrier without removing the blanket and disturbing the child. The device also includes a securing means for the bifurcated leg portion. This allows the leg portion to fold down for ease of entry into the blanket, and creates an extended tube portion that covers the infant's torso, keeping the infant completely covered.

2. Description of the Prior Art

Several devices have been disclosed in the art that create a specially designed blanket for wrapping an infant. Smith, U.S. Pat. No. 6,415,442 discloses an infant wrap having a quadrangular, generally bilaterally symmetrical sheet of fabric material, the sheet having a generally rectangular central region for covering the back side of an infant's torso, overlapping upper and lower flaps attached to first and second opposing sides. Also, U.S. Pat. No. 4,611,353 to Heidelise discloses an infant's garment having a sack portion adapted to receive the legs of an infant, and two flaps attached to the sack adapted to wrap around the infant's arms and overlap behind the body. While these devices are designed to wrap an infant, they do not have a bifurcated leg portion allowing for use in an infant seat carrier or safety seat.

Many devices are adapted to fit inside a five-point harness in an infant seat carrier. Hay, U.S. Pat. No. 5,950,261 discloses a blanket wrap tailored to mount to a car seat or infant carrier. Safety restraints at the support mount through the wrap to permit attachment of the straps to the infant or toddler prior to fitting the wrap to the infant. McEntire, U.S. Pat. No. 5,781,946 discloses a blanket for portable infant car seats comprising of a flat cross-shaped member, a strap located on each side of said mid section area, a leg pocket member, a slit at center of said leg pocket member, a central opening to accommodate shoulder-body strap locking devise, a storage pocket member, and a storage pocket closure member. These designs use specific holes and cutouts, allowing the safety harness to pass through the blanket. This requires opening the blanket when inserting or removing an infant from a carrier, which can potentially wake or disrupt a sleeping child.

Other designs in the prior art do not have a bifurcated leg portion to allow use in an infant carrier. Mohler, U.S. Pat. No. 5,046,204 discloses an article for wrapping an infant comprising a sheet of fabric material, having a generally triangular left-hand, a generally triangular right-hand side flap, first and second booties depending from lower regions of the sheet for receiving the feet of an infant resting along a vertical central region of the sheet, and a hood in upper regions of the sheet for receiving the head of the infant. The side flaps each have a sufficient sideward length to enable the flaps to wrap sidewardly over the infant when it is resting along the vertical center region of the sheet and to overlap one another by a substantial amount. Chancey, U.S. Pat. No. 6,757,922 discloses a bifurcated wrap-around covering. The covering is made to straddle a vertical obstruction in the crotch area of a child's seating structure and made to wrap a child's legs into leg compartments. Though these devices utilize bifurcated leg portions, the leg portions do not extend over the infant's torso, leading to gaps in the blanket that can make the child cold or allow movement, thereby defeating the purpose of the blanket and swaddling wrap.

The present invention utilizes a unique design that allows for use in an infant carrier, safety seat or infant car seat, and further covers the infant's body completely. By using a bifurcated leg design, the device will not interfere with the crotch strap of a five point harness in an infant carrier. The device also includes a securing means for the bifurcated leg portion, allowing for ease of entry when placing the infant in the blanket. Once the child is properly positioned, the securing means is secured, thereby completely covering the infant's torso. The design of the present invention substantially diverges in design elements from the prior art and consequently it is clear that there is a need in the art for an improvement to existing infant blanket wraps. In this regard the instant invention substantially fulfills these needs.

SUMMARY OF THE INVENTION

In view of the foregoing disadvantages inherent in the known types of infant blanket wraps now present in the prior art, the present invention provides a new infant blanket wrap wherein the same can be utilized for providing convenience for placing a wrapped infant inside an infant seat carrier.

It is therefore an object of the present invention to provide a new and improved infant blanket wrap device that has all of the advantages of the prior art and none of the disadvantages.

Another object of the present invention is to provide a bifurcated infant blanket wrap for a child seated in an infant carrier seat or car seat having a crotch strap.

Still another object of the present invention is to provide a bifurcated infant blanket wrap which surrounds and protects both legs entirely and provides a gap between each leg.

Another object of the present invention is to provide a bifurcated infant blanket wrap that can be quickly applied and removed.

A further object of the present invention is to provide a bifurcated infant blanket wrap that allows placement of a sleeping child into or out of an infant seat carrier without waking.

Still another object of the present invention is to provide a bifurcated infant blanket wrap that covers the leg and torso portion of the infant user entirely.

Another object of the present invention is to provide a bifurcated infant blanket wrap that can be used as a covering blanket and also as a wrap.

Yet another object of the present invention is to provide a bifurcated infant blanket wrap that is machine washable and dryable.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
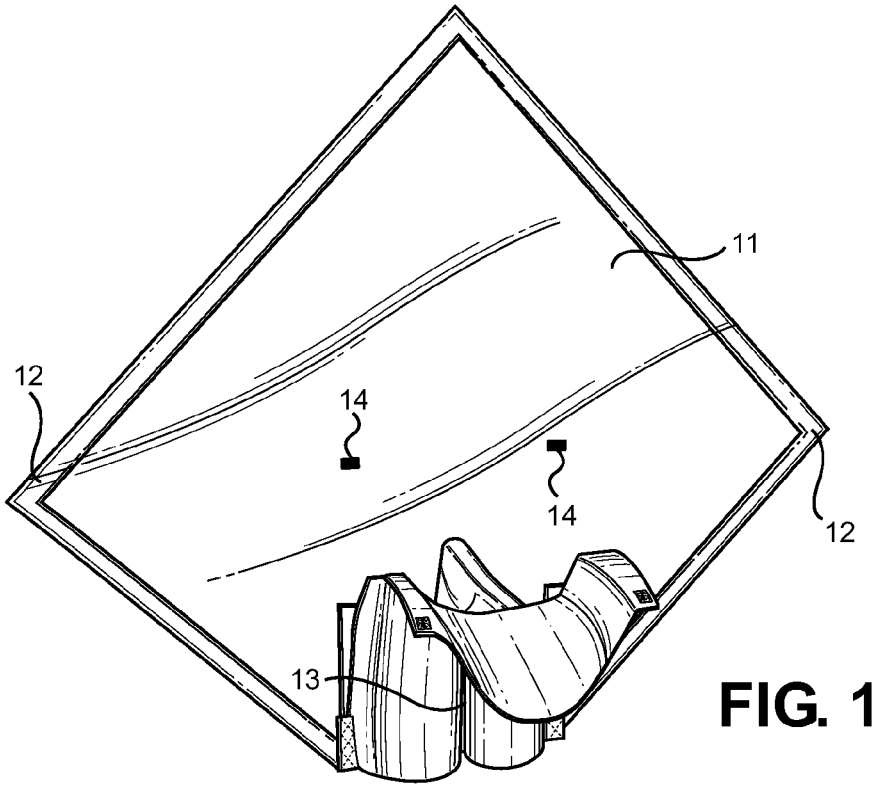
FIG. 1 shows a perspective view of the present invention comprising an article of material, two flaps, a bifurcated leg portion and a securing means at the upper terminal end in the open position.
Figure 3:
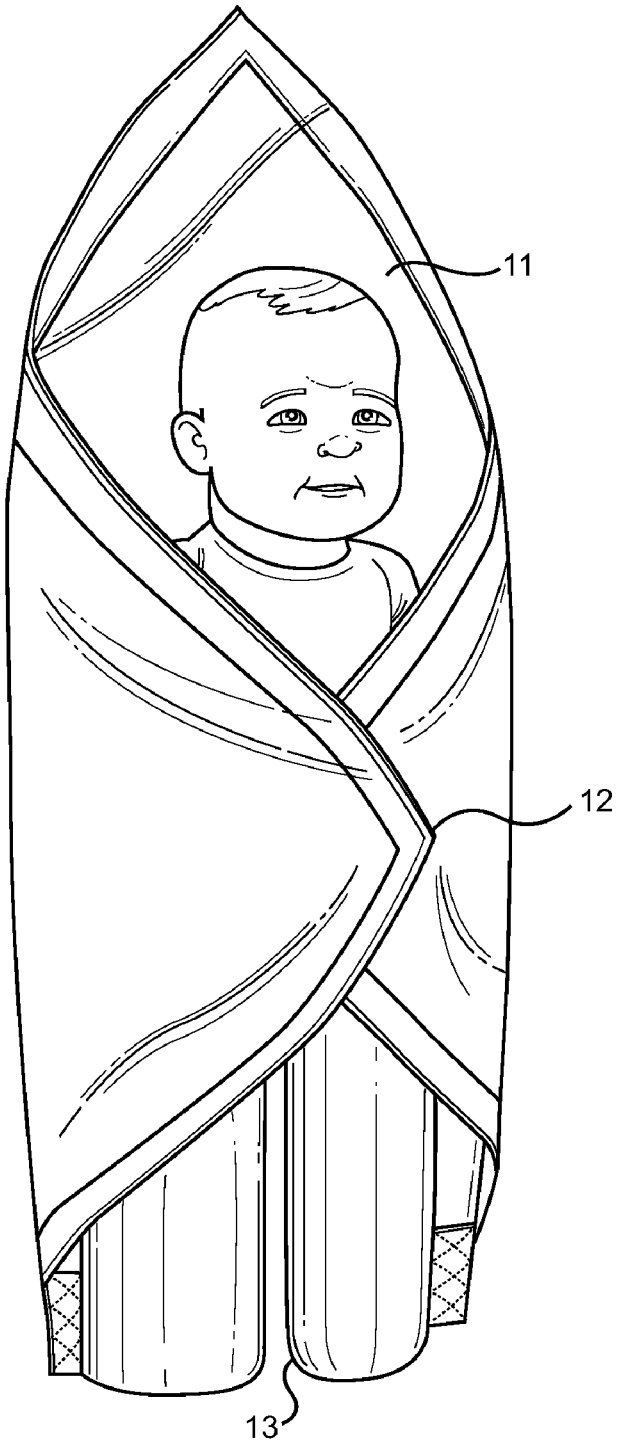
FIG. 3 shows a perspective view of the present invention including an infant wrapped in the swaddled position.

Referring now to FIG. 1, there is shown a perspective view of the present invention, comprising an article of wrap material 11, two flaps 12, a bifurcated leg portion 13, and a securing means 14 in the open position. The wrap 11 can be any shape that will receive an infant and cover its torso. In the preferred embodiment, the wrap 11 is generally diamond shaped. A diamond shape creates two flaps 12 on the left side and the right side of the infant. The flaps 12 cover the infant's torso, when overlapped as shown in FIG. 3. The wrap material 11 may be designed to keep an infant warm or alternatively be breathable for warmer climates. Its base material and construction is desirably an easily washable and dryable type. Materials such as fleece, flannel, quilting, microfiber, cotton or stretchable material are preferably used.

The bifurcated leg portion 13 is located along a vertical centerline of the wrap 11 at a lower terminal portion thereof, and creates a cover for the infant's torso. The leg portion 13 forms two pouches that are constructed and sized to receive the infant's legs. The leg portion 13 separates the wrap 11 and creates two pockets, thereby forming the bifurcated leg portion 13 with a separated inner slit that allows independent wrapping of each leg. The separation extends from the bottom of the wrap 11 up to joint of the infant's legs 15 to allow for secure positioning of a crotch strap of a three or five point harness against the infant's body. By creating a pouch for each leg, the crotch strap can be secured around the infant in a safe and secure manner.

The securing means 14 at the upper terminal end of the bifurcated leg portion 13 is a key improvement of the present invention. The securing means 14, which is preferably secured by hook and loop fasteners, allows the upper end of the leg portion 13 to fold outward from the wrap 11, making for ease of entry into the leg portion 13. This procedure can be particularly difficult without an extended opening for placement of an infant's legs. Many infants move their legs rapidly, making it difficult to place their legs in the proper opening. Folding the upper end of the leg portion 13 outward prevents the infant's legs from being inserted into the wrong opening or having the child's legs interfere with their entry therein. The securing means 14 also allows the upper terminal end of the leg portion 13 to extend higher up the torso of the infant along the material after insertion of the infant's legs. This added length prevents the infant's torso from exposure or dislocation from the leg portion 13 if the flaps 12 become loosened.

Figure 2:
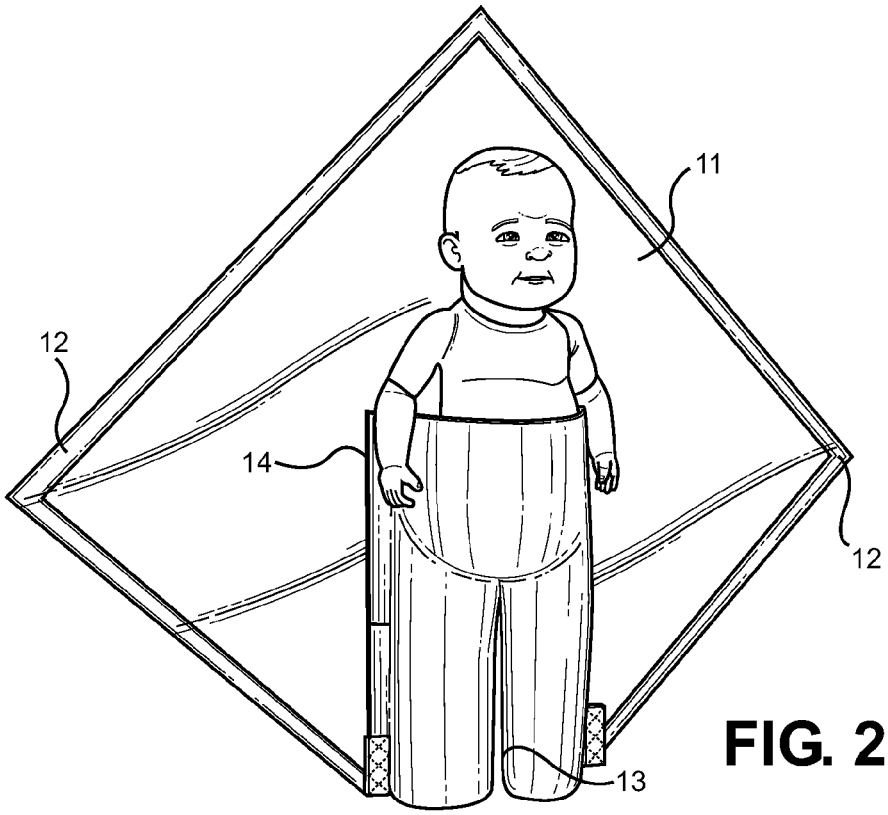
FIG. 2 shows a perspective view of the present invention with an infant having its torso in the bifurcated leg portion and securing means in the secured position.

Referring now to FIG. 2, there is shown a perspective view of the present invention, including an infant with its torso in the bifurcated leg portion 13 and securing means in the secure position. The infant's legs are inserted into the bifurcated leg portion 13 along a vertical centerline of the wrap 11. To insert an infant into the leg portion 13, a user opens the wrap such that it lays flat with the leg portion 13 facing upwards, unfastens the fastening means 14 of the leg portion 13 upper region, inserts the infant's legs into the openings created by the leg portion 13 and attaches the upper region of the leg portion to the wrap via the securing means 14 to enclose the legs and lower torso of an infant.

Referring now to FIG. 3, there is shown a perspective view of the present invention, wherein an infant is wrapped in a swaddled position. The infant's legs are placed in the bifurcated leg portion 13 of the present invention, and the upper end of the leg portion 13 is secured by the securing means 14 as in FIG. 2. To place the infant in the swaddled position, the flaps 12 are folded over the torso of the infant and overlapped. The flaps 12 are large enough to wrap completely around the infant, creating a compartment that holds the infant securely. The flaps 12 utilize a securing means to prevent loosening during transport from the infant's movements, preferably hook and loop fasteners; however, buttons, snaps, or various other fasteners are acceptable. This keeps the flaps 12 in position while transporting the infant and prevents the infant from opening the flaps 12. Hook and loop fasteners allow for a plurality of adjustments, making the present invention suitable for multiple sized infants. It may alternatively be desired to leave the flaps 12 unsecured, relying on the length of the flaps and the positioning of the baby to maintain the structure of the wrap.

Overall, the present invention provides a baby wrap or swaddle blanket of any geometric shape or size that comprises a bifurcated leg portion with a large entry point and securing means therefor to allow easy insertion of an infant's legs. Once wrapped and secured, the infant may be transported by a caretaker or placed into a baby carrier or car seat utilizing a crotch strap. The separation provided between the infant's legs while wrapped allows securement of this strap, and thus improved safety, comfort and security of the infant while placed therein.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A blanket for wrapping an infant and keeping it warm while the baby is seated in a child seat having a five-point harness, comprising:

a uniformly solid article of material having a plurality of flaps, and a bifurcated leg portion for receiving an infant's legs;

said leg portion having an upper and lower region, said lower region being attached to said article of material and said upper region being unattached to provide a large opening for said infant's legs and extending over said infant's torso and terminates prior to reaching said infant's armpits;

said plurality of flaps each having a sufficient length to wrap sidewardly over an infant's torso a securing means disposed along laterally opposing sides of said upper region for removably securing said bifurcated leg portion upper region to said article of material, wherein said leg portion can be reduced in height by folding said upper region downward until it lies flat upon said lower region;

said laterally opposing sides of said bifurcated leg portion upper region fits closely around said infant's torso when secured to said article of material to permit the fastening of a car seat five-point harness around the torso of an infant wrapped in said article of material flaps.

2. The article of claim 1, wherein said flaps overlap one another and secure together via a securing means.

3. The article of claim 2, wherein said securing means comprises hook and loop fastening.

4. The article of claim 1, wherein said bifurcated leg portion is positioned along a vertical center line of said article of material.

5. The article of claim 1, wherein said article of material is constructed of stretch material.

6. The article of claim 1, wherein said article of material is generally diamond shaped.

* * * * *